US007334312B2

(12) United States Patent
Bucholtz et al.

(10) Patent No.: US 7,334,312 B2
(45) Date of Patent: Feb. 26, 2008

(54) METHOD OF FORMING AXLES WITH INTERNALLY THICKENED WALL SECTIONS

(75) Inventors: Dennis Bucholtz, St. Clair, MI (US); Earl Barker, St. Clair, MI (US); Joseph A Simon, Jr., Grosse Pointe Farms, MI (US)

(73) Assignee: U.S. Manufacturing Corporation, Warren, MI (US)

( * ) Notice: Subject to any disclaimer, the term of this patent is extended or adjusted under 35 U.S.C. 154(b) by 138 days.

(21) Appl. No.: 11/063,470

(22) Filed: Feb. 23, 2005

(65) Prior Publication Data

US 2006/0185148 A1 Aug. 24, 2006

(51) Int. Cl.
*B23P 19/02* (2006.01)

(52) U.S. Cl. ..... 29/525; 29/DIG. 47; 72/370.01; 72/370.14

(58) Field of Classification Search ..... 29/525, 29/447, DIG. 47; 72/253.1, 260, 264, 265, 72/266, 267, 268, 370.01, 370.02, 370.03, 72/370.14
See application file for complete search history.

(56) References Cited

U.S. PATENT DOCUMENTS 2,065,595 A * 12/1936 Lynch ..... 285/333
3,077,090 A * 2/1963 Haushalter ..... 464/90
3,808,838 A * 5/1974 Bowen et al. ..... 464/89
3,837,205 A 9/1974 Simon
3,886,649 A * 6/1975 Simon ..... 228/112.1
4,272,971 A * 6/1981 Loyd et al. ..... 464/181
4,277,969 A * 7/1981 Simon ..... 72/266
4,292,831 A 10/1981 Simon
4,301,672 A * 11/1981 Simon ..... 72/370.03
4,435,972 A * 3/1984 Simon ..... 72/256
4,454,745 A * 6/1984 Cudini ..... 72/283
4,487,357 A * 12/1984 Simon ..... 228/173.5
4,513,489 A * 4/1985 Sugiyama et al. ..... 29/520
4,759,111 A * 7/1988 Cudini ..... 29/523
4,982,592 A * 1/1991 Simon ..... 72/260

(Continued)

FOREIGN PATENT DOCUMENTS

JP 08219668 A * 8/1996

*Primary Examiner*—Essama Omgba
(74) *Attorney, Agent, or Firm*—Harness, Dickey & Pierce, P.L.C.

(57) ABSTRACT

A method for forming a variable wall thickness axle or tube with internally thickened wall sections comprises extruding a tubular metal blank within an elongated die. An elongated punch pushes the blank through the die. The punch has an end abutting and pushing the blank into and through the die and an elongated portion which is spaced from the interior wall surface of the die. Movement of the punch in pushing the blank causes the blank to partially extrude forwardly through the die until stopped and then to extrude rearwardly around the punch elongated portion through the space for forming a tube. A tubular ring is then inserted within the extruded tube at a pre-determined location and is fixed in place to provide a thick, combined tube wall and ring wall, section which extends radially inwardly of the tube. A number of spaced-apart rings may be used to provide spaced-apart thickened wall sections within the tube. The rings may be pre-formed with variable wall thickness around their circumferences for varying the thicknesses of the combined wall sections around the circumference of the tube.

20 Claims, 3 Drawing Sheets

U.S. PATENT DOCUMENTS 4,991,421 A * 2/1991 Simon ..... 72/260
5,052,845 A * 10/1991 Maus et al. ..... 403/36
5,069,080 A * 12/1991 Simon ..... 74/422
5,070,743 A * 12/1991 Simon ..... 74/579 R
5,105,644 A * 4/1992 Simon ..... 72/260
5,205,464 A * 4/1993 Simon ..... 228/114
5,320,580 A 6/1994 Simon
5,333,775 A * 8/1994 Bruggemann et al. ..... 228/157
5,346,432 A * 9/1994 Greulich et al. ..... 464/180
5,522,246 A * 6/1996 Simon ..... 72/260
5,902,186 A * 5/1999 Gaukel ..... 464/162
6,189,199 B1 * 2/2001 Ouchi et al. ..... 29/557
6,409,606 B1 * 6/2002 Nakajima et al. ..... 464/181
6,609,301 B1 * 8/2003 Morris et al. ..... 29/897.1
6,779,375 B1 * 8/2004 Alexoff ..... 72/370.02
6,807,837 B1 * 10/2004 Alexoff ..... 72/276
7,090,309 B2 * 8/2006 Blessing et al. ..... 301/124.1
2004/0200255 A1 * 10/2004 Newport et al. ..... 72/370.14
2005/0126250 A1 * 6/2005 Fredrick, Jr. ..... 72/370.01
2006/0131949 A1 * 6/2006 Jahani et al. ..... 301/124.1

* cited by examiner

METHOD OF FORMING AXLES WITH INTERNALLY THICKENED WALL SECTIONS

BACKGROUND OF THE INVENTION

This invention relates to a method for fabricating a tube, such as an axle-type tube, with inwardly thickened, separated, wall sections.

Axle-type and other similar types of tubular structures, have been formed by extrusion processes which produce wall sections which are inwardly thickened. That is, such tubes have substantially uniform wall thicknesses along their lengths, but at one or more locations along their lengths, the wall thicknesses are increased radially inwardly. Examples of such extrusion processes for providing inwardly thickened wall sections on tubular structures, are disclosed in a number of U.S. patents. Such patents include U.S. Pat. No. 3,837,205 issued Sep. 24, 1974 to Joseph A. Simon for "Process For Cold Forming A Metal Tube With An Inwardly Thickened End." Another patent, U.S. Pat. No. 3,886,649 issued Jun. 3, 1975 to Joseph A. Simon for a "Process For Cold Forming A Metal Tube With An Inwardly Thickened End," discloses such an extrusion process. Further patents of Joseph A. Simon which disclose the formation of inwardly thickened portions at the ends of, and within the interior of a tube are: U.S. Pat. No. 4,277,969 issued Jul. 14, 1991 for a "Method Of Cold Forming Tubes With Interior Thicker Wall Sections"; U.S. Pat. No. 4,292,831 issued Oct. 6, 1981 for a "Process For Extruding A Metal Tube With Inwardly Thickened End Portions"; and U.S. Pat. No. 5,320,580 issued Jun. 14, 1994 for a "Lightweight Drive Shaft."

In the processes disclosed in the foregoing patents, a tubular, short length, metal blank is extruded through a die by a punch which pushes the blank endwise through a die throat. The punch includes an extending mandrel portion which is inserted within the blank and is suitably configured to enable the formation of interior, integral, thickened wall portions within the extruded tube. Such disclosed processes result in elongated tubular members that have provided thickened end portions and thickened interior portions which reinforce the tube in places where needed or for improved strength or for fastening purposes.

These are effective, and relatively economical methods for forming tubes which are strengthened in pre-selected areas while reducing the weight of a tube by providing a thinner wall between the thicker sections. The present invention relates to a method which enables the production of such tubes having interior wall thicknesses more economically.

SUMMARY OF THE INVENTION

This invention contemplates forming a tube, such as a tube useful for vehicle axles and for other structural purposes, by initially extruding a tube with a substantially uniform wall thickness in an extrusion process. First, a tubular blank is forwardly extruded into a partial tube which may have a forward configured end portion. Then the remaining portion of the blank is rearwardly extruded into a uniform wall thickness, cross-sectional shaped tube. Next, separate rings may be inserted within the uniform wall thickness tubular portion of the tube and secured in place, such as by press-fitting or shrink-fitting for selectively thickening the wall of the tube at places where the additional wall thickness is needed. The wall thicknesses of the rings may vary along the circumference of the ring. Thus, the rings may provide a variable wall thickness in the radially inward direction and a thickening wall portion in the longitudinal direction of the tube.

The method contemplates the formation of tubing which may be circular or non-circular in cross-section. The cross-sections may be varied by using, for example, a circular ring with an axially offset hole or a non-circular hole or a non-circular tube within which a non-circular ring is inserted. The shape of the ring will depend in part upon the purpose for which the finished tube is to be used.

An object of this invention is to provide a method for economically forming tubular structures having interior thickened wall sections of pre-determined lengths and pre-determined radially inward thicknesses.

A further object of this invention is to provide a method by which various cross-sectional tubing may be relatively economically and rapidly produced and, thereafter, may be reinforced along selective portions of the tube, by thickening the tube walls in the radially inward direction by emplacing pre-sized and shape rings within the interior wall of the tubes.

Still a further object of this invention is to provide a method for rapidly producing tubes of pre-determined circular and/or non-circular cross-section with a pre-formed end configuration, as for example, a formation for supporting a vehicle wheel, with the remainder of the tube being selectively strengthened by increasing the wall thicknesses of the tube at selected locations where greater loads or stresses are anticipated during the use of the tube.

These and other objects and advantages of this invention will become apparent upon reading the following description, of which the attached drawings form a part.

DETAILED DESCRIPTION OF THE PREFERRED EMBODIMENTS

Figure 7:
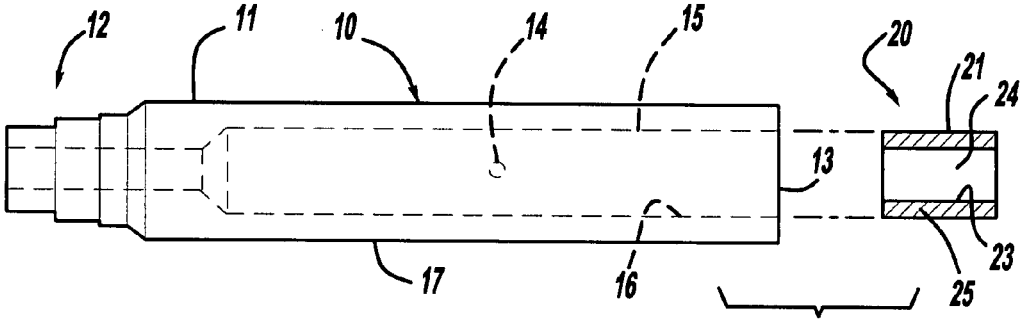
FIG. 7 illustrates an elevational view of the extruded tube and the positioning of an insert or ring (shown in cross-section) ready for installation within the extruded tube.
Figure 8:
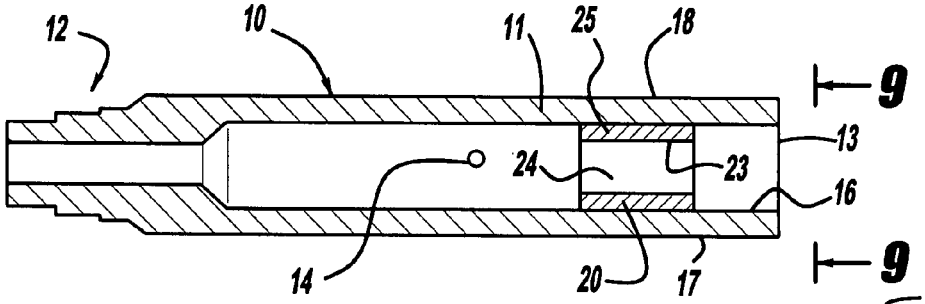
FIG. 8 is a cross-sectional view, schematically showing the positioning of a ring within the tube for thickening a pre-determined section of the tube wall.
Figure 9:
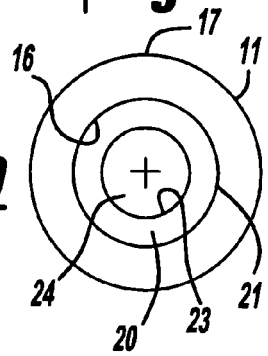
FIG. 9 is an end view, taken in the direction of Arrows 9-9 of FIG. 8 of the open end of the tube with the ring inserted in place.

Referring to FIGS. 7-9, an axle-type tube 10 is formed with a main, elongated, tubular portion 11 and a configured wheel support end portion 12. The main tubular portion has an open end 13 and a central opening 14 which extends the length of the tube.

The wall 15 of the tube has an interior wall surface 16 and an outside or exterior wall surface 17.

The wall 15 of the main tubular portion 11 is shown as having been formed with a substantially uniform wall thickness. Thus, it is desired to provide a section or location 18 where the tube is substantially thickened in the inward, radially endward direction.

An insert or ring 20 is provided (see FIGS. 7 and 8), having an outside peripheral surface, that is, a circumferential surface 21 which closely matches the shape and size of the wall interior surface 16 of the tube. Preferably, the ring is of a slightly larger size than the wall surface, as will be explained further.

The ring has an inside wall surface 23 which defines a hole 24 through the ring. Thus, the wall 25 of the ring, illustrated in FIG. 7, for example, is of a uniform cross-section but of a thickness which when combined with the thickness of the tube wall 15 produces the overall increased wall thickened section desired.

Figure 1:
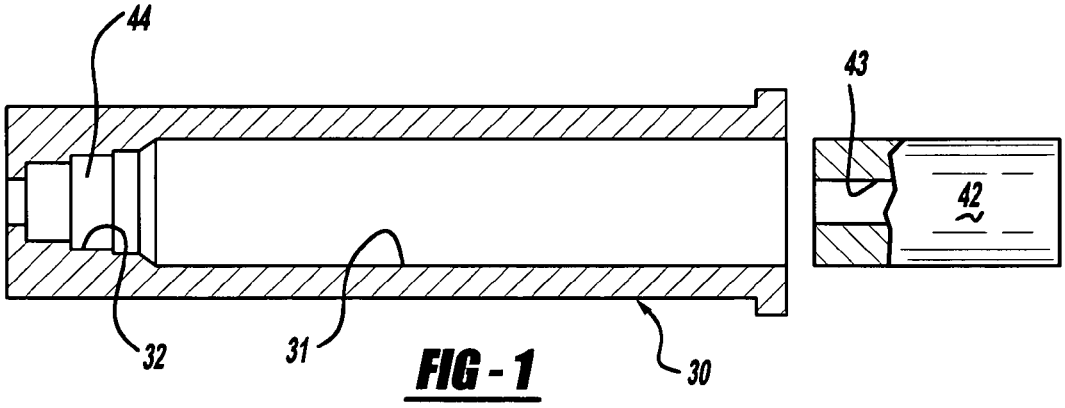
FIG. 1 is a schematic, cross-sectional view of the extrusion die and a blank arranged for insertion into the die.

To form the tube, as shown in FIG. 1, an elongated die 30 is provided. The die has a central passageway 31 and has a configured end portion 32 for forming an end of a predetermined configuration, such as for providing a wheel connection portion, or such other end portion as may be desired for a particular purpose.

Figure 3:
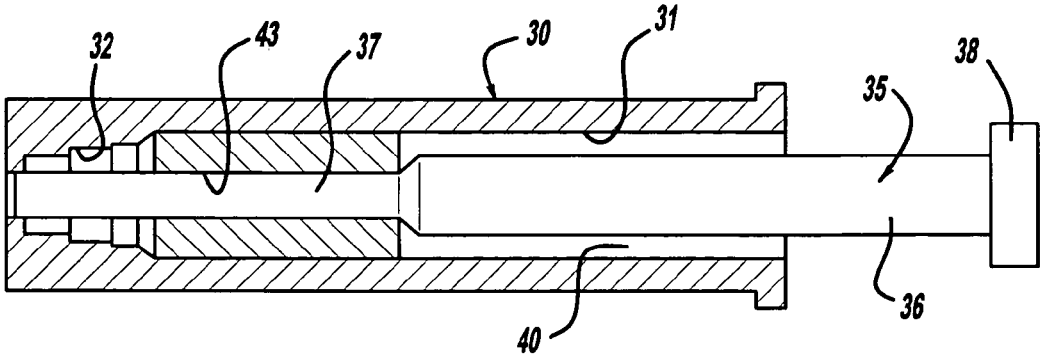
FIG. 3 schematically illustrates the extrusion punch inserted within the die and the blank.

As shown in FIG. 3, an extrusion punch 35 may be fitted within the die passageway 31. The punch includes a main body portion 36 and a mandrel extension 37 of pre-determined lengths to provide the particular length and shape desired. The punch, in the schematic illustration, is shown as having a head 38 which is intended to schematically illustrate a device for pressing the punch forwardly through the die and then retracting the punch after the extrusion of the tube is completed.

The main body portion 36 of the punch is smaller in cross-section than the cross-section of the passageway 31 of the die. Thus, a gap or space 40 is provided between the punch surface and the interior wall surface of the die.

Figure 2:
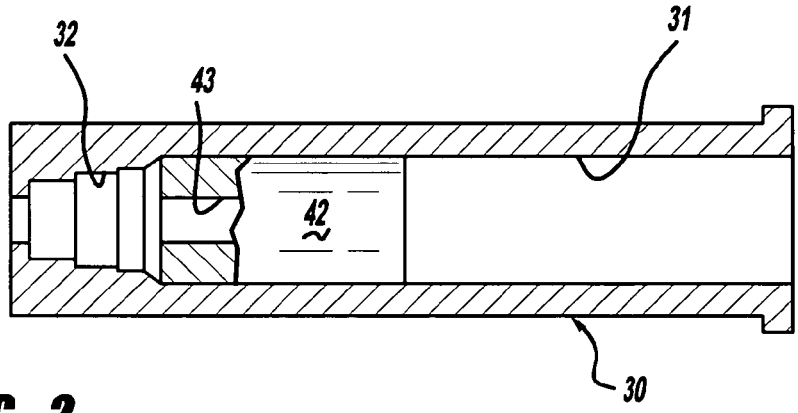
FIG. 2. schematically illustrates a blank inserted within the extrusion die, shown in cross-section.

To form a tube, a blank 42 is initially provided. The blank is shaped in the form of a short length of tubing with a central passageway or opening 43 (see FIG. 1). The blank is inserted endwise into the passageway in the die. The lead end of the blank, referred to at times as the remote end or lead end, is inserted into the die as shown in the position in FIG. 2. The end nearer to the die opening, referred to as the trailing end or the proximal end, is located well within the die.

As shown in FIG. 3, the punch is then inserted so that its mandrel extension, extends through the blank passage or opening 43 and, as mentioned above, its main body portion 36 is spaced from the interior wall of the die.

Figure 4:
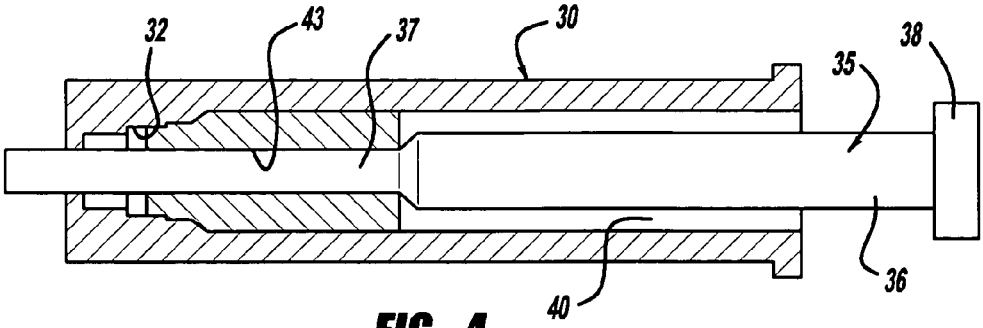
FIG. 4 schematically illustrates the punch moved partway forwardly and the partial extrusion of the lead or forward end of the blank.

Next, the punch is moved forwardly for pressing against the trailing or proximal end of the blank and forcing the blank forwardly through the die throat 44. Thus, the lead or remote end of the blank begins to take the shape of the configured throat, as schematically illustrated in FIG. 4.

Figure 5:
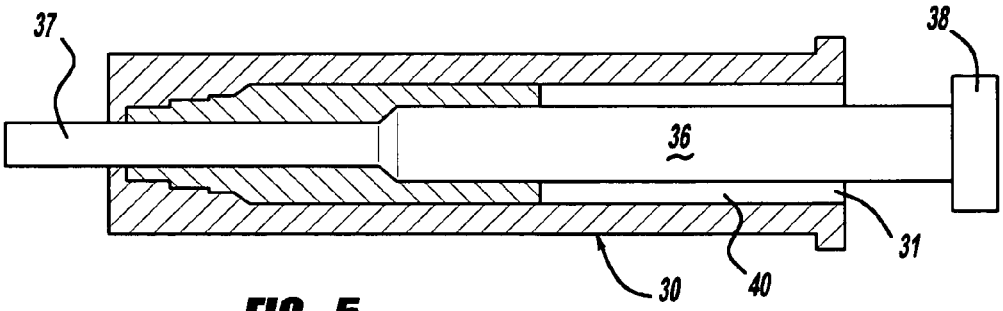
FIG. 5 schematically illustrates the punch moved further in the forward extrusion direction, for completing the extrusion of the forward or lead end of the blank and the partial rearward extrusion of portions of the blank into the space between the die wall and the punch.
Figure 6:
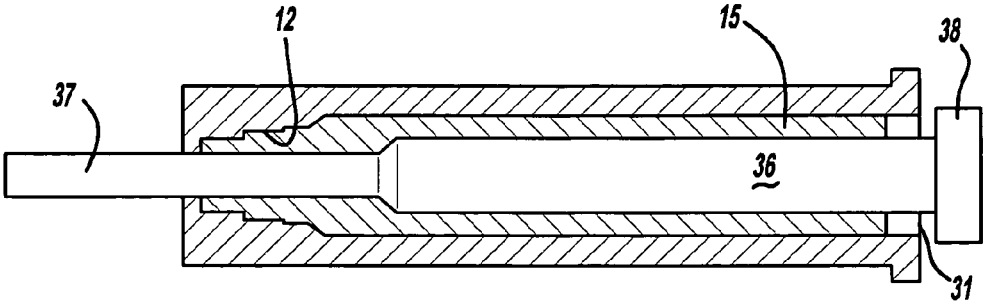
FIG. 6 illustrates the completion of the movement of the punch for completing the formation of the lead or forward end of the tube and the formation of the rearwardly extruded tube wall between the punch and the die wall.

Once the forward extrusion of the die is completed, as shown in FIG. 5, continued forward movement of the punch results in the proximal end portion of the blank flowing rearwardly under the extrusion pressure, into the gap 40 between the punch main body portion 36 and the interior wall surface of the die. Further forward motion of the punch (see FIG. 6) results in the completion of the backward or rearward extrusion of the proximal end of the blank to form the complete main tubular portion or tube wall 15. Thus, the extruded tube, as illustrated in FIG. 6, comprises the forward configured or lead end portion 12 and the main tubular portion 11 (FIG. 8).

The pre-formed ring 20 (see FIGS. 7-9) has an exterior surface which closely corresponds to the interior surface 16 of the wall of the tube portion 11. Preferably, the ring is of a slightly larger size, in cross-sectional area and dimension than the interior cross-section of the opening 14 of the tube portion 11. Hence, the ring may be press-fitted, that is, forced into the open end of the tube and pushed to its desired location where it overlaps the desired thickening section or location 18 of the tube. By being oversized, relative to the opening in which it fits, the tube will permanently remain in place, held by friction between the engaged surfaces. Alternatively, the tube and ring may be assembled by shrink-fitting them together. In that system, either the ring is cooled sufficiently to reduce its dimensions for sliding it into place within the tube. Alternatively, the tube is heated for expanding it and the ring is slid endwise into the tube to the desired location where the natural shrinkage of the tube tightly locks the ring and tube together. Hence, the composite or combined wall thicknesses of the ring wall 25 and the overlapped section 18 of the tube wall 15 provide the thickened wall section at the desired place.

Figure 10:
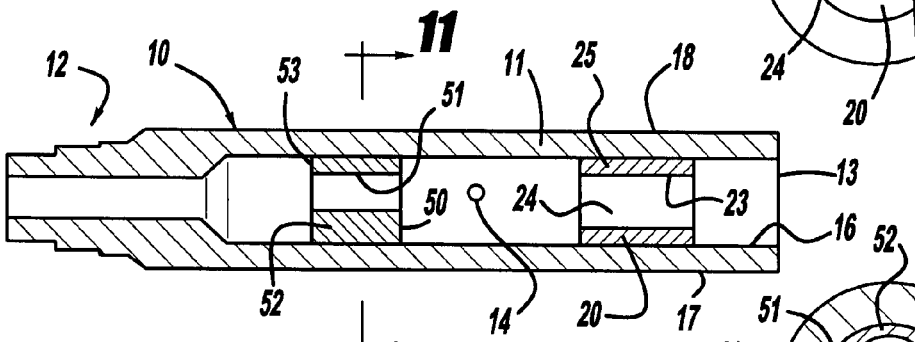
FIG. 10 is another schematic, cross-sectional view illustrating an extruded tube having two different rings inserted within the tube for showing the different length and thicknesses produced by different length and a variable thickness rings.
Figure 11:
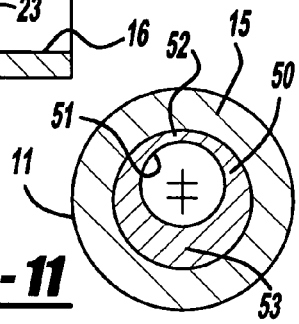
FIG. 11 is a cross-sectional view taken in the direction of arrows 11-11 of FIG. 10, showing a ring whose opening is axially offset to provide a variable thickness ring wall.

FIG. 10 illustrates an embodiment wherein more than one ring is utilized. Schematically illustrated is a second ring 50 located at a spaced location from the first mentioned ring for providing a second thickened portion within the tube. A number of such rings may be used, as desired. In the case of the second ring 50 illustrated in FIG. 10, its opening 51 is offset relative to the axis of the tube (see FIG. 11) so that the ring has a variable thickness wall around its circumference. Thus, it can be seen schematically that the lower portion 52 of the ring in FIG. 10 is thicker than the upper ring portion 53. Thus, the thicker combined tube section and ring varies around the periphery of the ring and tube. The ring may be inserted within the tube with its thicker wall portion oriented to provide maximum in thickness where desired, for example, around the lower portion of the tube as compared to the upper portion (FIG. 10). Also, although not shown, the opening 51 through the second ring 50 may be varied in its cross-sectional configuration for providing thicker or thinner wall sections at different locations around the circumference of the ring. For example, the ring hole may be square, or oval, or hexagonal, etc. in cross-section to vary the thicker wall sections. Similarly, the tube and/or its interior opening may be non-circular, e.g. square with the ring being correspondingly shaped.

The use of a number of rings, all of the same size and shape or, alternatively, of different wall thicknesses and locations of thicker and thinner wall portions, enables the design and production of a tube which is structurally stronger and capable of withstanding various stresses imposed upon the tube, while avoiding the necessity of having the entire tube made of a much thicker wall throughout its length. Thus, the weight of a tube and the amount of metal consumed in forming the tube is substantially reduced while providing thicker, stronger tube sections at the specific locations where needed.

This invention may be further developed within the scope of the following claims. Having fully disclosed an operative embodiment of this invention, we now claim:

What is claimed is:

1. A method for forming an axle having selectively internally thickened wall sections, comprising:

extruding a short, tubular metal blank into an elongated tube of substantially uniform cross-section with a substantially uniform cross-sectional thickness wall;

forming one end portion of the tube into a wheel end support, with the opposite end of the tube being open and with said opening being of the same cross-sectional shape as the elongated tube cross-section;

providing a tubular ring of an axial length substantially equal to the length of a pre-determined thickened location of the wall of the tube, that is, to a section of the wall of the tube to be thickened;

said ring being of an outside circumference that is slightly greater than the internal diameter of the tube and having an interior opening of selected shape, size and location so as to define desired axle wall thicknesses along the circumference of the ring when the ring is positioned at a desired axial location within the tube;

inserting the ring into the tube opening and positioning the ring within the tube to overlap the section of the tube wall to be thickened while orienting the ring within the tube portion for creating desired wall section thicknesses at pre-determined circumferential locations relative to the tube wall;

permanently fixing the ring in said location for forming a combined ring and tube wall thickness at said location;

whereby the axle is formed with a wall section which extends radially inwardly relative to the inner wall of the tube and which is thicker than the extruded tube wall thickness.

2. A method for forming an axle as defined in claim 1, and including extruding the wheel end support integrally with the tube when the tube is extruded.

3. A method for forming an axle as defined in claim 1, and including forming the wheel support separately from the tube;

permanently securing the wheel support to an end of the tube to form the wheel support end of the tube.

4. A method as defined in claim 1, and including extruding the tubular blank within an elongated die having a die wall through which the blank is extruded, comprising:

placing the blank within an elongated die, having a die wall co-axially with the die wall, with the tube having an entry end into which the blank is inserted, and the blank having a remote end portion and a proximal end portion;

pushing the blank endwise into the die, for extruding the blank remote end through the die with an elongated punch;

said punch being of a cross-sectional shape that is smaller than the interior cross-sectional shape of the die wall, for providing a space between the punch and the die wall;

stopping the endwise movement of the blank after it is partially extruded through the die;

continuing pushing the blank forwardly, that is, away from the entry end of the die, and extruding the proximal end portion of the blank rearwardly, that is, towards the entry end of the die, through the space between the punch and die wall to form an elongated, substantially uniform in cross-section, tube portion;

removing the punch and removing the extruded tube from the die;

providing a short, tubular ring having an exterior circumferential shape corresponding to the shape and size of the interior wall formed in the elongated tube portion;

inserting the ring into the tube portion and positioning the ring at a pre-determined location within the tube;

permanently fixing the ring at said location for forming an inwardly thickened wall section from the combined tube and ring walls at the pre-determined location within the tube portion.

5. A method as defined in claim 4, and including providing a second ring, similar to the first mentioned ring, within the tube at a second pre-determined location for providing a second thicker wall section spaced from the first mentioned section, within the tube portion.

6. A method as defined in claim 4, and said ring being secured within the tube by press-fitting the ring into the tube for frictionally interlocking the ring to the tube wall.

7. A method as defined in claim 4, and including shrink-fitting the ring within the tube by relatively reducing the exterior circumferential dimensions of the ring with respect to the tube wall and then reestablishing the relative sizes of the ring and the tube wall for fixing the ring permanently to the tube wall.

8. A method as defined in claim 1, wherein said interior opening of said ring is circularly-shaped.

9. A method as defined in claim 1, wherein said interior opening of said ring is non-circularly-shaped.

10. A method as defined in claim 1, wherein said interior opening of said ring has a central axis that is offset from a central axis of said ring.

11. A method for forming an elongated tube having internally thickened wall sections, comprising:

extruding a short, tubular, metal blank into an elongated tube of substantially uniform cross-section with a substantially uniform cross-sectional thickness wall;

forming one end of the extruded tube with an opening corresponding to the cross-sectional shape of the interior wall of the elongated tube cross-section;

providing a tubular ring of an axial length substantially equal to the length of a pre-determined increased wall thickness location of the wall of the tube, that is, a section of the tube wall to be thickened;

said ring being formed of an outside circumference that corresponds to, but is slightly greater than the internal shape of the tube and having an interior opening of selected shape, size and location so as to define desired tube wall thicknesses along the circumference of the ring when the ring is positioned at a desired axial location within the tube;

inserting the ring into the tube opening and positioning the ring to overlap the section of the tube wall to be thickened while orienting the ring within the tube portion for creating desired wall section thicknesses at pre-determined circumferential locations relative to the tube wall;

fixing the tube wall to the interior, overlapped wall portion of the tube for forming an inwardly thickened, combined ring wall and tube wall section at said pre-determined location.

12. A method as defined in claim 11, and including providing a second ring, similar to the first mentioned ring within the tube at a second pre-determined location within the tube, for providing a second thicker wall section, spaced from the first mentioned wall section, within the tube.

13. A method as defined in claim 11, wherein said interior opening of said ring is circularly-shaped.

14. A method defined in claim 11, wherein said interior opening of said ring is non-circularly-shaped.

15. A method as defined in claim 11, wherein said interior opening of said ring has a central axis that is offset from a central axis of said ring.

16. A method for forming an elongated tube with at least one inwardly thickened wall section, comprising:

preparing a tubular blank of a pre-determined length for forming the tube by extrusion;

positioning the blank within a die having an elongated die opening for receiving the tube;

pushing the tube with a punch, through the die opening for extruding the blank through an end portion of the die;

said punch being formed of a cross-sectional shape that is smaller than the interior cross-sectional shape of the die to provide a space between the punch and the wall forming the opening in the die;

stopping end-wise extrusion movement of the blank in a forward direction while continuing the pressure upon the blank in the forward direction to cause the blank to rearwardly extrude, that is, relative to the movement of the punch, into the space between the punch and the die to form an elongated tube extrusion in said space;

removing the punch and removing the extruded tube from the die; and inserting at least one short, tubular ring within the extruded tube and fixing the ring within a location that is pre-determined for thickening a portion of the tube wall inwardly; said ring having an exterior peripheral surface engaged with the wall forming the interior surface of the tube for forming a combined thickened, radially inwardly extended, wall section within the tube;

said ring being pre-formed with an interior opening of selected shape, size and location so as to define desired tube wall thicknesses along the circumference of the ring when the ring is positioned at a desired axial location within the tube.

17. A method as defined in claim 16, and pre-forming the ring with a wall of varying thickness around the periphery of the ring for circumferentially varying the radially directed thickness of the combined ring and tube wall.

18. A method defined in claim 16, wherein said interior opening of said ring is circularly-shaped.

19. A method as defined in claim 16, wherein said interior opening of said ring is non-circularly-shaped.

20. A method defined in claim 16, wherein said interior opening of said ring has a central axis that is offset from a central axis of said ring.

* * * * *